US011891874B2

(12) United States Patent
Fripp et al.

(10) Patent No.: US 11,891,874 B2
(45) Date of Patent: Feb. 6, 2024

(54) SELF-ASSEMBLING POROUS GRAVEL PACK IN A WELLBORE

(71) Applicant: Halliburton Energy Services, Inc., Houston, TX (US)

(72) Inventors: Michael Linley Fripp, Singapore (SG); Cem Sonat, Singapore (SG); Stephen Michael Greci, Little Elm, TX (US); Brandon Thomas Least, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/811,568

(22) Filed: Jul. 8, 2022

(65) Prior Publication Data

US 2024/0011365 A1 Jan. 11, 2024

(51) Int. Cl.

| | |
|---|---|
| ***E21B 33/12*** | (2006.01) |
| ***E21B 23/04*** | (2006.01) |
| ***E21B 33/122*** | (2006.01) |

(52) U.S. Cl.

CPC ..... *E21B 33/1208* (2013.01); *E21B 23/04* (2013.01); *E21B 33/122* (2013.01)

(58) Field of Classification Search

CPC .... E21B 33/1208; E21B 23/04; E21B 33/122; E21B 43/04

See application file for complete search history.

(56) References Cited

U.S. PATENT DOCUMENTS

| | | | | |
|---|---|---|---|---|
| 7,836,952 | B2 | 11/2010 | Fripp | |
| 8,091,637 | B2 | 1/2012 | Fripp | |
| 10,316,601 | B2 | 6/2019 | Walton et al. | |
| 10,612,659 | B2 * | 4/2020 | Xu | C22C 32/0047 |
| 2003/0131997 | A1 * | 7/2003 | Chatterji | E21B 43/04 166/278 |
| 2007/0044963 | A1 * | 3/2007 | MacDougall | E21B 33/13 166/278 |
| 2007/0068675 | A1 * | 3/2007 | Barry | E21B 43/045 166/278 |
| 2010/0139929 | A1 * | 6/2010 | Rytlewski | E21B 33/1208 166/134 |
| 2011/0098202 | A1 * | 4/2011 | James | C09K 8/5086 507/221 |
| 2011/0247812 | A1 | 10/2011 | Panga et al. | |
| 2012/0031612 | A1 | 2/2012 | Lembcke | |

(Continued)

OTHER PUBLICATIONS

International Search Report and Written Opinion, PCT/US2022/073575, dated Mar. 29, 2023, 10 pages.

*Primary Examiner* — Theodore N Yao

(74) *Attorney, Agent, or Firm* — Kilpatrick Townsend & Stockton LLP

(57) ABSTRACT

A system for a wellbore can include a tubing string positioned downhole in a wellbore and a porous gravel pack. The porous gravel pack can be positioned in an annulus defined at least in part by a surface of the tubing string. The porous gravel pack can be made up of a plurality of grains. Each grain can include a core surrounded at least in part by a sheath. The core can comprise an expandable material that can expand in response to coming in contact with a fluid. The sheath can surround the core and can be deformable in response to the core expanding in response being exposed to a fluid.

18 Claims, 5 Drawing Sheets

(56) References Cited

U.S. PATENT DOCUMENTS

| | | | | |
|---|---|---|---|---|
| 2014/0102728 | A1* | 4/2014 | Gamstedt | E21B 33/02<br>166/387 |
| 2019/0078420 | A1 | 3/2019 | Han et al. | |
| 2021/0189817 | A1 | 6/2021 | Fripp et al. | |
| 2022/0186104 | A1 | 6/2022 | Fripp et al. | |

* cited by examiner

SELF-ASSEMBLING POROUS GRAVEL PACK IN A WELLBORE

TECHNICAL FIELD

The present disclosure relates generally to wellbore completion operations and, more particularly (although not necessarily exclusively), to gravel packs used in completion wellbore operations.

BACKGROUND

A wellbore can be formed in a subterranean formation for producing hydrocarbons, producing gas, or other formation fluids. Various wellbore operations can be performed with respect to the wellbore, and the various wellbore operations can involve positioning wellbore tools or materials in the wellbore. For example, cement, screens, sleeves, a packer, or other suitable tools or materials can be positioned in the wellbore for use in stimulating the wellbore, producing hydrocarbons from the wellbore, completing the wellbore, or for other suitable purposes. The tools or materials may be positioned in the wellbore for forming one or more seals in the wellbore. One example of a well tool typically installed in a wellbore is a gravel pack. The gravel pack can be positioned between the subterranean formation and production tubing, and can be used in conjunction with a sand screen to filter sand and other solid particles from produced fluid before the produced fluid enters the production tubing.

DETAILED DESCRIPTION

Figure 1:
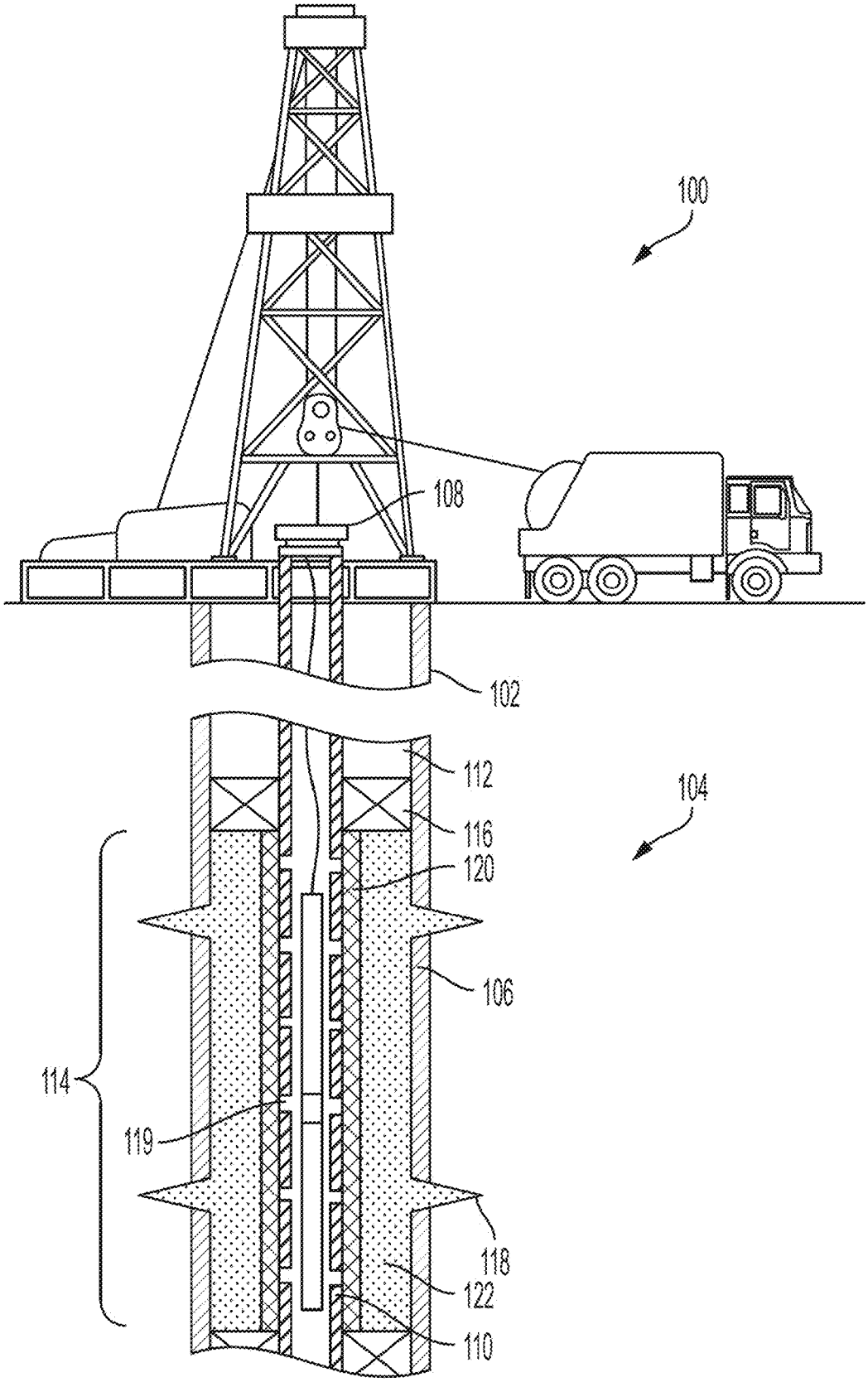
FIG. 1 is a cross-sectional side view of an example of a well system that includes a porous gravel pack according to some aspects of the present disclosure.

Certain aspects and examples of the present disclosure relate to a self-assembling porous gravel pack downhole in a wellbore. The porous gravel pack may be positioned on an outer surface of a tubing string in the wellbore, and may be self-assembling in response to contact with downhole fluids. The porous gravel pack may be used in an cased hole or open hole well. The porous gravel pack can include a plurality of grains that each include a core and a sheath. The core can be an expandable material that can expand in response to being exposed to fluids, such as downhole fluids. Additionally, exposed portions (e.g., portions not covered by the sheath) of the expandable material from each grain can come in contact with and bond with expandable material from other grains in the porous gravel pack upon expanding in response to being exposed to fluids. The sheath can also prevent a portion of the expandable material of one grain covered by the sheath from coming in contact with and bonding to a portion of the expandable material of an adjacent grain, providing a porosity in the porous gravel pack. Produced downhole fluids can flow through the porous gravel pack via the spaces between adjacent grains provided by the sheaths of the grains, which may filter out sand and other particles via the partially bonded and expanded grains. The filtered downhole fluids may then enter the tubing string.

In some aspects, a porous gravel pack according to aspects of the present disclosure may be attached to the tubing string prior to installation of the tubing string in the wellbore. For example, the porous gravel pack can be placed within a prepacked sand screen prior to installation of the tubing string downhole in the wellbore. Prepacked sand screens can hold the porous gravel pack within an outer shroud. As the prepacked sand screen is exposed to downhole fluids, the grains within the porous gravel pack can expand and stretch the outer shroud to provide improved sealing. In aspects in which the porous gravel pack is attached to the tubing string prior to installation of the tubing string in the wellbore, complicated operations involved in pumping a gravel pack downhole can be avoided, streamlining and simplifying the process. For example, pumping a gravel pack downhole after installation of the tubing string may require using multiple service strings and multiple boats to carry pumps, blenders, and proppant downhole. Additionally, the process of pumping a gravel pack downhole after installation of the tubing string may limit types of completions that can be used in the wellbore, such as the number of zones and the use of multilaterals. In contrast, a porous gravel pack according to aspects of the present invention can be placed without pumping. Avoiding pumping of a gravel pack after installation of a tubing string can eliminate or reduce the risk of wellbore sections having no gravel pack, the risk of fracturing the subterranean formation, and the risk of sanding the service string in the wellbore. In some examples, attaching the porous gravel pack to the exterior of the tubing string may enable new completion designs. Examples of new completion designs can include a porous gravel pack with an unlimited number of zones, a porous gravel pack in a multilateral wellbore, or a porous gravel pack in an extended reach horizontal wellbore.

In some examples, the porous gravel pack according to aspects of the present disclosure can be used in conjunction with traditional pumped gravel packing or sand screens. For example, the porous gravel pack may be used in sections of completion zones that are projected to have a poor pack, such as around pipe blanks. The addition of the porous gravel pack may increase sand control. In some examples, the porous gravel pack may be pumped downhole using traditional pumped gravel packing methods.

In some aspects of the present disclosure, the shape of grains within the porous gravel pack can be chosen to either enhance the expansion of the porous gravel pack in response to downhole fluids, and/or to aid fluid flow through the porous gravel pack. In some examples, the grains can be used as proppant in hydraulic fracturing operations.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a cross-sectional side view of an example of a well system 100 that includes a porous gravel pack 122 according to some aspects of the present disclosure. The well system 100 includes a wellbore 102 extending through a hydrocarbon-bearing subterranean formation 104. The wellbore 102 can be vertical, deviated, horizontal, or any combination of these. In some examples, the wellbore 102 can include a casing string 106. The casing string 106 can provide a conduit through which well fluids, such as production fluids produced from the subterranean formation 104, can travel from the wellbore 102 to the well surface 108.

The wellbore 102 can be divided into one or more production zones, such as production zone 114. The ends of each production zone can be defined by packers 116, which can create fluid seals around the production zone. Each production zone can include one or more perforations 118 in the casing string 106 to enable a well fluid to flow from the subterranean formation 104 into a tubing string 110.

The tubing string 110 can also have apertures 119 to enable well fluid to enter the tubing string 110. In some examples, such as the one depicted in FIG. 1, the well system 100 can include a sand control device 120, such as a sand screen, to surround the apertures 119 to limit sand inflow into the tubing string 110. A porous gravel pack 122 can also be positioned between the sand control device 120 and the casing string 106 to further limit sand inflow into the tubing string 110. In some examples, the porous gravel pack 122 can be positioned between the tubing string 111 and the sand control device 120. In other examples, the porous gravel pack 122 can be positioned between the casing string 106 and the tubing string 110, or between the tubing string 110 and the subterranean formation 104.

The porous gravel pack 122 can be self-assembling in response to coming into contact with downhole fluids in the wellbore 102. For example, the porous gravel pack 122 can include a plurality of grains that each comprise an expandable material that can swell in response to coming in contact with a fluid. A portion of a grain may bond to one or more adjacent grains upon expansion to define the porous gravel pack 122. The porous gravel pack 122, defined by the plurality of grains in an expanded position, can then filter the fluid before the fluid enters the tubing string 110. The porous gravel pack 122 can also support the subterranean formation 104 and prevent the subterranean formation 104 from collapsing.

Figure 2A:
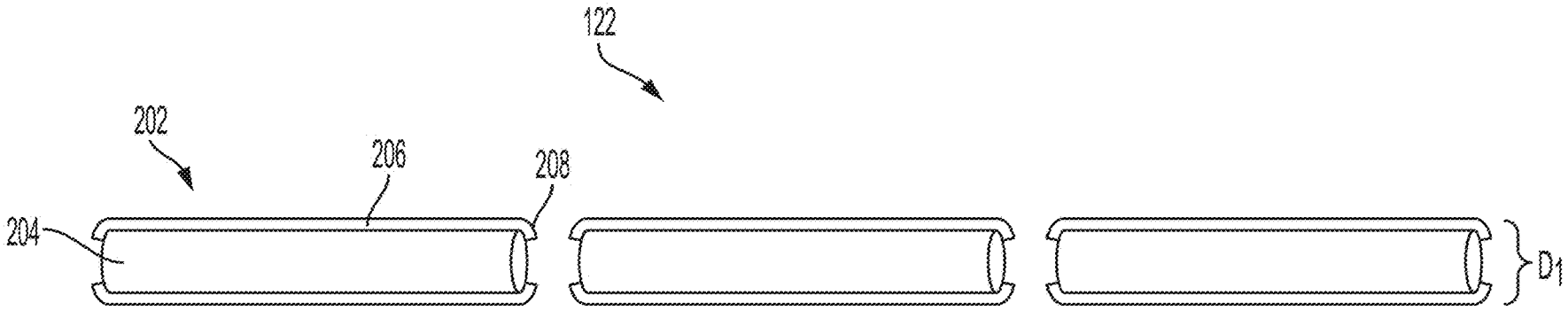
FIG. 2A is a cross-sectional side view of an example of a grain in an unexpanded position that may comprise a portion of a porous gravel pack according to some aspects of the present disclosure.

FIG. 2A is a cross-sectional side view of an example of a grain in an unexpanded position, for example grain 202, that may comprise a portion of a porous gravel pack 122 according to some aspects of the present disclosure. Each grain 202 can include a core 204 and a sheath 206 at least partially surrounding the core 204. For example, the sheath 206 may not fully extend over at least one of the ends 208 of the core 204. In some examples, the grain 202 may have an approximate diameter of from about ⅛ inch to about 1/16 inch. The core 204 may include an expandable material that can expand in response to coming in contact with a fluid, for example a downhole fluid. The expandable material may include a metal that can chemically react with downhole fluids to expand. Alternatively or additionally, the expandable material include a swellable polymer that can absorb downhole fluids to expand in volume.

For example, the expandable material can include a metal that can hydrolyze when subjected to the downhole fluid to form a hydrolyzed metal. The volume of the hydrolyzed metal can be substantially larger than the volume of the original metal. The expandable material can expand and harden into a cement-like material. The expandable material can include alkaline earth metals such as magnesium or calcium, or transition metals such as zinc or aluminum. In some examples, the expandable material can be a metal alloy. The metal alloy can be an alloy of the base metal with other elements in order to either adjust the strength of the metal alloy, to adjust the reaction time of the metal alloy, or to adjust the strength of the resulting metal hydroxide byproduct, among other adjustments. Examples of the other elements that can be alloyed to the base metal to adjust properties of the expandable material can include, but are not limited to, Al, Zn, Mn, Zr, Y, Nd, Gd, Ag, Ca, Sn, Re, Ni, Fe, Cu, Co, Ir, Au, C, Ga, In, Hg, Bi, Sn, and Pd.

The sheath 206 may be made of a metal material or a polymer material. For example, the sheath 206 can include a metal that is relatively pure or may include a metal alloy. Examples of a metal sheath 206 can include a steel alloy, a bronze alloy, Ni, Al, Cu, Sn, Zn, Ti, or a combination thereof. In some example, the sheath 206 can be a metallized ceramic such as a metal oxide or an anodized coating. Examples of a polymer sheath 206 can include elastomeric materials such as hydrogenated nitrile rubber, thermoplastic materials such as nylon, polyamide, polyvinylchloride, polystyrene, acrylonitrile butadiene styrene, polycarbonate, polysulfone, or thermoset materials such as silicone or vinyl. The polymer material can have a glass transition temperature less than or within 50° C. of a downhole temperature. Such a glass transition temperature can enable the polymer material to soften and more easily deform in response to expansion of the core 204.

Figure 2B:
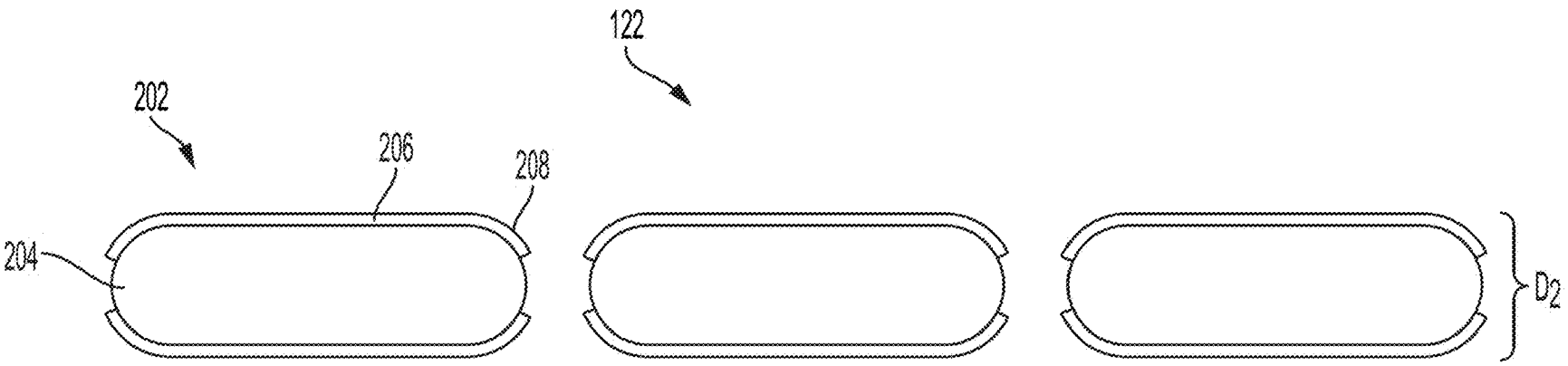
FIG. 2B is a cross-sectional side view of an example of the grain of FIG. 2A in an expanded position according to some aspects of the present disclosure.

The sheath 206 can be secured around the core 204 in various ways. For example, the core 204 may be a metal wire, and the sheath 206 may be created by dipping the metal wire in a polymer material, by wrapping the metal wire with a polymer tape, by wrapping the metal wire with a metal tape, or by inserting the metal wire into a polymer or metal tube. The sheath 206 can be formed through a surface treatment of the core such as through an oxidation reaction, a reduction reaction, or a surface chemical reaction. As shown in FIG. 2A the grain 200 can have a diameter $D_1$ in the unexpanded position. As depicted in FIG. 2B, the core 204 may expand in response to contact with fluid. The expansion of the core 204 in response to coming in contact with a fluid can cause the grain 200 to expand to a diameter of $D_2$ which is greater than the diameter of $D_1$. The sheath 206 can aid in controlling the expansion of the core 204 and can prevent the entirely of the cores 204 of adjacent grains 202 from bonding together and forming a solid material without fluid passageways.

In some examples, such as the one depicted in FIG. 2A, the ends 208 of the sheath 206 can be crimped to a reduced diameter to assist in controlling the expansion of the core 204 in response to contact with a fluid. As shown in FIG. 2B, the crimping of the sheath 206 at the ends 208 can cause the material of the core 204 to expand such that grain 202 expand from a cylindrical "wire" shape having a relatively consistent diameter along the length of the grain 202, to a obloid "hot dog" shape in which the diameter of the grain 202 is greater at the center region than at the ends 208.

Grains 202 may have additional shapes in the unexpanded an expanded positions provided by features of the sheath 206, for example but not limited to through partial crimping, rolling, and/or thickness variations in the sheath 206, or by only partially filling the sheath 206 with the core 204, or by only partially covering the core 204 with a sheath 206. A cross-section of the sheath 206 can be continuous, a spiral, a split ring, or corrugated. The shapes of the grains 202 can be varied based on the desired purpose of the porous gravel pack 122. For example, a grain 202 with a length-to-diameter ratio that is close to 1 may be treated like a spheroid and a flowable shape in the pre-expanded condition. Alternatively, a grain 202 with a length-to-diameter ratio that is much greater than 1 can be a nail-like shape that tends to lock together when expanded. For example, the nail-like shape can be an acicular shape such as cylinder or a compound shape such as a plus shape or a staple shape. A grain 202 in an acicular shape may provide the benefit of requiring less material to fill a space, as acicular shaped materials can tend to lock together to form a bridge. In some examples, grains 202 with length-to-diameter ratios that are greater than 2 may provide higher porosity in the porous gravel pack 122 upon expansion.

For example, a porous gravel pack 122 comprising grains 202 each having a spheroid shape when expanded can have a porosity of from about 20% to about 50%. Such a porous gravel pack 122 can have a porosity of from about 20%-50%, 25%-45%, 30%-35%, 30%-40%, 40%-50%, 36%-39%, 37%-38%, 37%-40%, or 35%-37%. A porous gravel pack 122 with grains 202 in an acicular shape can have a porosity of from about 50% to about 90% while maintaining similar sand retaining performance to a porous gravel pack 122 with grains 202 in a spheroid shape. For example, the porous gravel pack can have a porosity of from about 55%-85%, 60%-80%, 65%-75%, 50%-80%, 60%-80%, 73%-87%, 75%-85%, 77%-83%, 79%-81%, 70%-80%, 80%-90%, 75%-85%, 85%-90%, 70%-75%, 75%-80%, or 80%-85%. The volume of the grain 202 may increase from the unexpanded position to the expanded position by a ratio of 4:1 or greater. Additionally, the tendency of grains 202 with an acicular shape to lock together via their needle-like edges can be enhanced with increased surface friction on the sheath 206. For example, increasing the surface friction of the sheath 206 can reduce movement between adjacent grains 202. Other shapes or features that can enhance locking between adjacent grains 202 can include divots, surface roughness, friction coatings, multiple segments, corpuscular shapes, or barbell shapes.

Unlike a temporary barrier coating that may last for hours or days at most and is meant to disintegrate, the sheath 206 remains during the lifetime of the grain 202, though it may change its shape/orientation. The sheath 206 may contain the expandable material of the core 204 to prevent a portion of the expandable material from a first core from bonding with a portion of the expandable material from a second core that is adjacent the first core. By preventing portions of the adjacent cores 204 from bonding such that a fluid passageway for production flow can be maintained through grains 202 that together define the porous gravel pack 122 after expansion of the cores 204. The production flow can therefore be filtered through the porous gravel pack 122 via the fluid passageways provided by the sheaths 206 restraining and covering portions of the cores 204. In some examples, the sheath 206 can be used to maintain a certain size of the grain 202. Additionally, the sheath 206 may protect the expandable material of the core 204 from degradation over time. The material of the sheath 206 can be selected to control the lifetime of the sheath 206, for example to last for months or years and may vary based on downhole conditions such as temperature in the wellbore 102. For example, the sheath 206 may be metal rather than polymer in wellbores with hotter temperatures. Having a metal sheath 206 in hotter temperatures can ensure that the sheath 206 does not disintegrate or melt, which may cause a seal to be formed between the plurality of grains 202 rather than maintaining fluid passageways between the plurality of grains 202 that define the porous gravel pack 122.

Figure 3A:
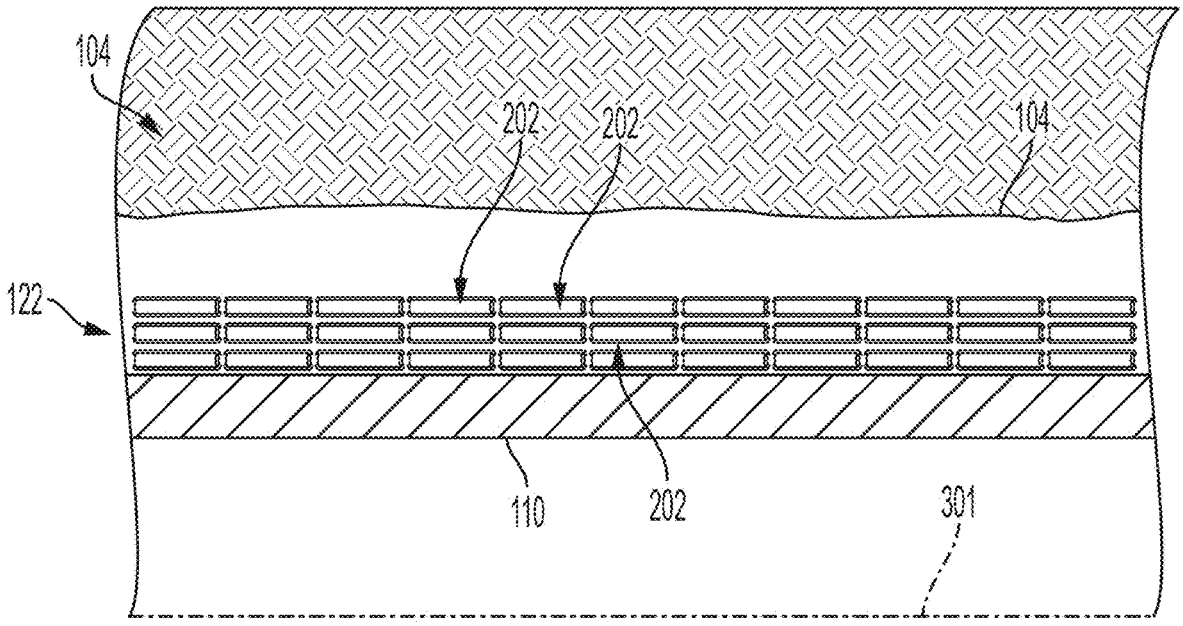
FIG. 3A is a cross-sectional side view of an example of a portion of a wellbore including a plurality of grains in an unexpanded position that together form a porous gravel pack according to some aspects of the present disclosure.

FIG. 3A is a cross-sectional side view of an example of a portion of a wellbore, for example the wellbore 102, including a plurality of grains 202 in an unexpanded position that together form a porous gravel pack 122 according to some aspects of the present disclosure. In some aspects, the grains 202 that together define the porous gravel pack 122 can be attached to an exterior of a tubing string 110 prior to the insertion of the tubing string 110 downhole in the wellbore. The dashed line 301 can indicate a center line of the tubing string 110. The grains 202 of the porous gravel pack 122 can be attached to the tubing string 110 and to each other with a dissolvable glue, such as a glue that can dissolve in response to contact with downhole fluids. The porous gravel pack 122 may be attached to some or all of the tubing string 110. By attaching the porous gravel pack 122 to the exterior of the tubing string 110 prior to insertion of the tubing string 110 downhole, rather than pumping the porous gravel pack 122 into the wellbore 102, an outer diameter of the downhole components can be minimized. In an alternative example, the porous gravel pack 122 may be positioned downhole after insertion of the tubing string 110, for example via pumping. The porous gravel pack 122 may be positioned between a surface, including but not limited to an outer surface, of the tubing string 110 and the subterranean formation 104. In some aspects, the porous gravel pack 122 may be positioned between an outer surface of the tubing string 110 and a casing of the wellbore. In some aspects, the porous gravel pack 122 may be positioned between the tubing string 110 and a screen assembly, for example as depicted in FIG. 4. In still yet other aspects, the porous gravel pack 122 may be positioned between an outer surface of a screen assembly and the subterranean formation 104. In some aspects, as shown in FIG. 3A, in the unexpanded position, the grains 202 defining the porous gravel pack 122 may not fully extend to the subterranean formation 104 such that there is an annulus between the porous gravel pack 122 and the subterranean formation 104.

Figure 3B:
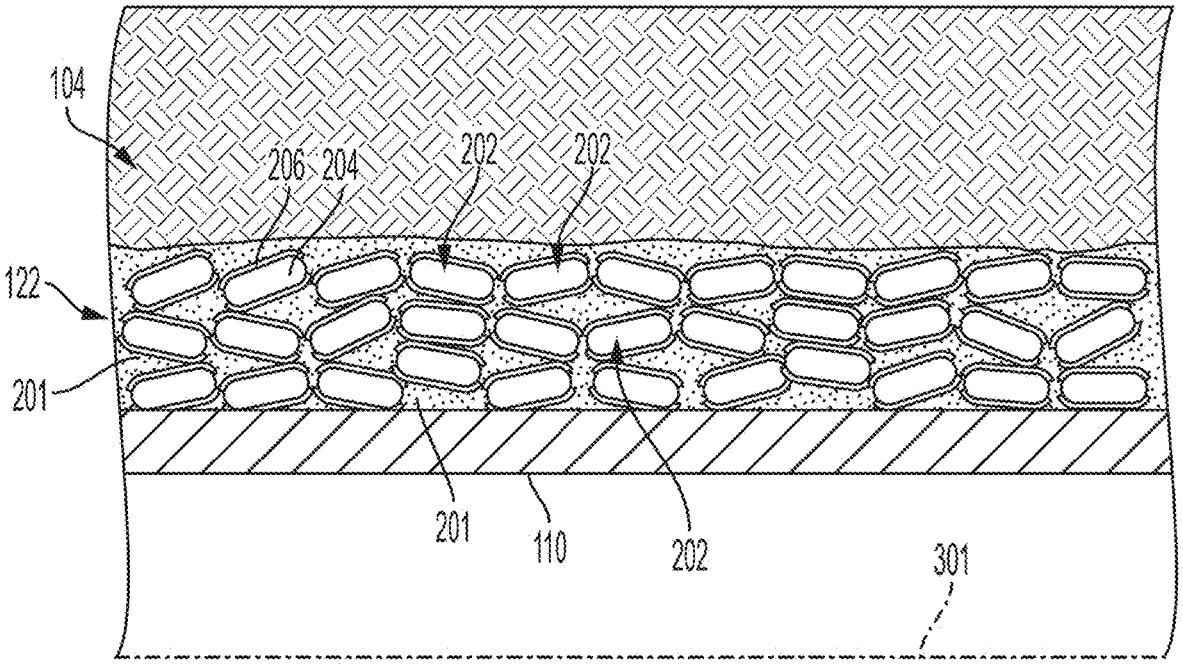
FIG. 3B is a cross-sectional side view of a portion of a wellbore including a plurality of grains in an expanded position that together form a porous gravel pack in the wellbore according to some aspects of the present disclosure.

After the tubing string 110 and the grains 202 defining the porous gravel pack 122 are positioned downhole within the wellbore 102, the grains 202 can be exposed to fluids, for example fluid 201. For example, brine, oil-based fluid, or produced wellbore fluids from the subterranean formation 104 can contact the porous gravel pack 122 to cause expansion of the grains 202. As shown in FIG. 3B, in response to being in contact with a fluid, the plurality of grains 202 can each expand such that they extend into and fill the annulus between the tubing string 110 and the subterranean formation 104 that was present when the grains 202 were in the unexpanded position. The fluid can contact the exposed portions of the core 204 that are not covered by the sheath 206, causing the core 204 to expand. In some examples, a core 204 including a polymer material may expand in response to coming in contact with an oil-based fluid. The portion of the grain 202 covered by the sheath 206 may also expand, and the sheath 206 may deform to accommodate the expansion of the core 204. The exposed and expanded portions of the core 204 from a first grain can contact the exposed and expanded portions of a core 204 from a second grain that may be adjacent to the first grain. The exposed portions of the cores 204 may bond together to create links between the grains 202 while retaining fluid pathways between grains 202 provided at least in part by portions of the sheath 206 that prevent the entirety of the cores 204 from adjacent grains 202 from contacting one another. Thus, the sheaths 206 may prevent portions of a grain 202 from contacting and bonding with portions of another grain 202, in particular the cores 204 of adjacent grains 202, such that fluid pathways extend between the grains 202. The fluid may flow through the spaces between the grains 202 and into the tubing string 110.

In some examples, the porous gravel pack 122 may be attached directly to the exterior of the tubing string 110. Additionally or alternatively, a sand control device depicted in FIG. 1, such as a sand screen can be attached to the exterior of the tubing string 110, and the porous gravel pack 122 may be attached to the exterior of the sand screen. In other examples, such as the one depicted in FIGS. 4A-4B, the porous gravel pack 122 can be secured between an outer surface of the tubing string 110 and an inner surface of the sand screen 402. The grains 202 may be pre-packed between the tubing string 110 and the sand screen 402 prior to positioning the tubing string 110 downhole.

Figure 4A:
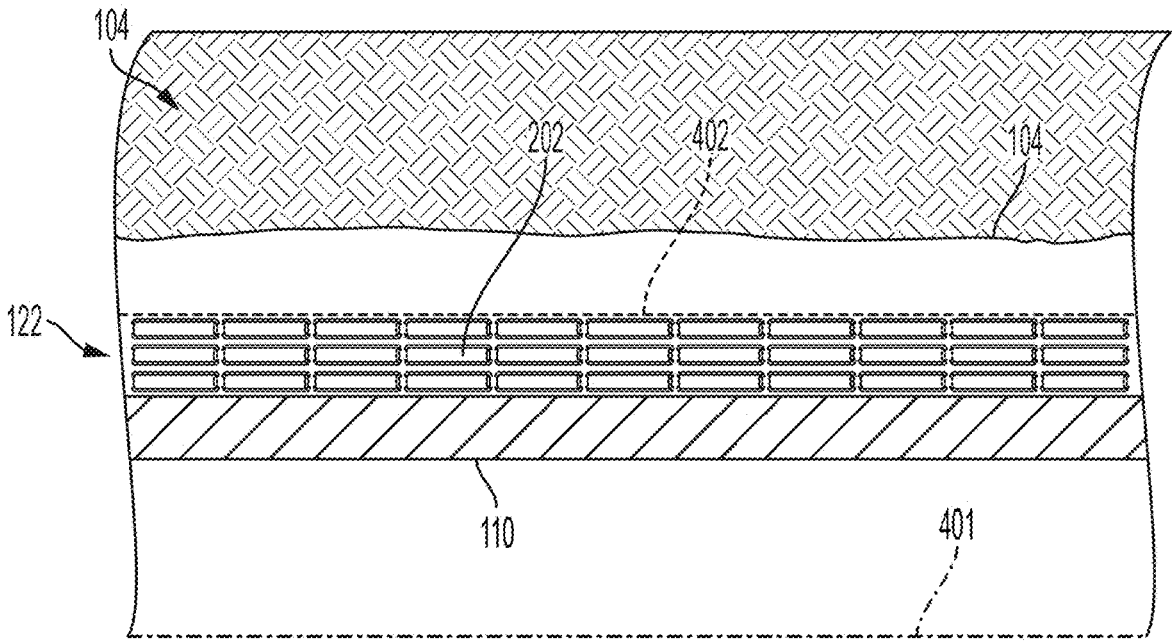
FIG. 4A is a cross-sectional side view of another example of a portion of a wellbore including a plurality of grains in the unexpanded position that together form a porous gravel pack in the wellbore according to some aspects of the present disclosure.

FIG. 4A is a cross-sectional side view of another example of a portion of a wellbore, for example wellbore 102, including a plurality of grains 202 in the unexpanded position that together form a porous gravel pack 122 according to some aspects of the present disclosure. Before expansion, the porous gravel pack 122 can be held within an outer shroud 402 of a pre-packed sand screen, such as the sand control device 120 depicted in FIG. 1. The outer shroud 402 may hold the grains 202 within the porous gravel pack 122 against the tubing string 110 while tubing string 110 is deployed downhole. The dashed line 401 can indicate a center line of the tubing string 110.

Figure 4B:
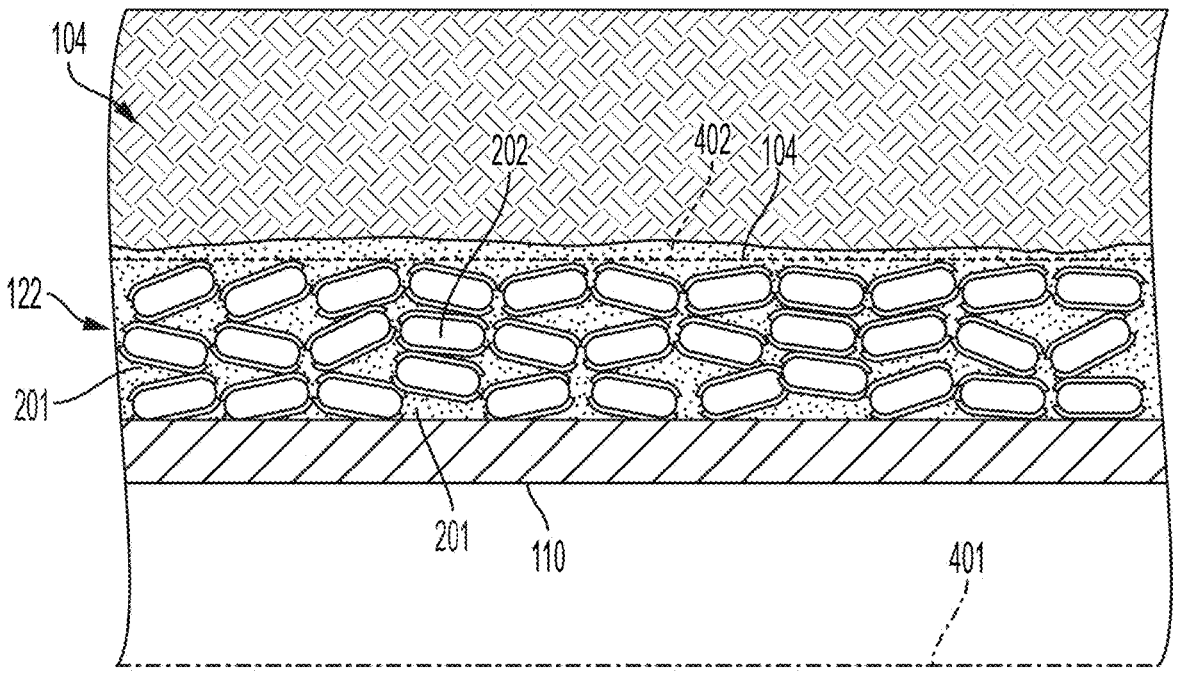
FIG. 4B is a cross-sectional side view of the portion of the wellbore of FIG. 4A including the plurality of grains in the expanded position that together form a porous gravel pack in the wellbore according to some aspects of the present disclosure.

After the tubing string 110 with the porous gravel pack 122 held by the outer shroud 402 is placed within the wellbore 102, the porous gravel pack 122 can be exposed to fluids, for example fluid 201. The grains 202 in the porous gravel pack 122 can expand in response to contact with the downhole fluids as shown in FIG. 4B. The outer shroud 402 can deform to accommodate the expansion of the grains 202. In some examples, the outer shroud 402 can be a plastic material that can stretch in response to an expansion of the porous gravel pack 122 to provide improved sealing or filtering. In other examples, the outer shroud 402 can have pleats that can unfold or unwrap to accommodate the expansion of the grains 202. The grains 202 expand in response to being in contact with fluid and the sheaths 206 can control expansion of the cores 204 so as to provide for fluid passageways when the grains 202 are in their expanded position to define the porous gravel pack 122.

Figure 5:
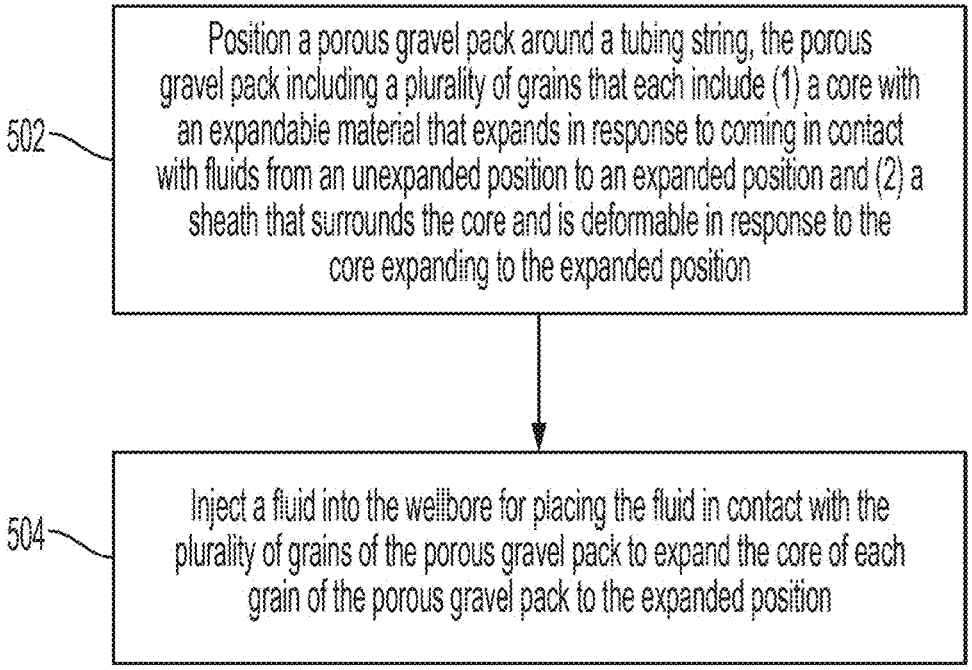
FIG. 5 is a flow chart of an example of a process for installing a porous gravel pack comprising a plurality of grains within a wellbore according to some aspects of the present disclosure.

FIG. 5 is a flow chart of an example of a process for installing a porous gravel pack comprising a plurality of grains, for example porous gravel pack 122 comprising grains 202, within a wellbore according to some aspects of the present disclosure. The steps below are discussed with reference to the components discussed above with respect to FIGS. 1-4.

At block 502, the process involves positioning a porous gravel pack 122 around a tubing string 110. The porous gravel pack 122 can include a plurality of grains 202, and each grain 202 can include a core 204 surrounded by a sheath 206. The core 204 can include an expandable material that can expand in response to coming in contact with a fluid, for example a downhole fluid. The core 204 can expand from an unexpanded position to an expanded position. The sheath 206 can be deformed in response to the core 204 expanding to the expanded position. The sheath 206 can be a permanent or long-lasting barrier, as opposed to a temporary coating. The material of the sheath 206 may vary depending on wellbore conditions. For example, a sheath 206 made of polymer may be a permanent barrier for the porous gravel pack 122 in a low-temperature wellbore 102. But, the sheath 206 made of polymer may not be an effective permanent barrier for the porous gravel pack 122 in a high-temperature wellbore 102, as the polymer may melt or degrade.

In some examples, the porous gravel pack 122 may be attached, such as with dissolvable adhesive, against an exterior of the tubing string 110. The porous gravel pack 122 may be used alone or in conjunction with other tools, such as traditional pumped gravel pack or sand screens. In some examples, the porous gravel pack 122 may be deposited downhole into areas of the wellbore 102 with a poor pack. In some examples, a sand control device 120 can be positioned between the porous gravel pack 122 and the wellbore 102 to hold the porous gravel pack 122 against the tubing string 110. In some examples, the plurality of grains 202 of the porous gravel pack 122 can be secured to the tubing string 110 prior to positioning the tubing string 110 downhole in the wellbore 102.

At block 504, the process involves injecting a fluid into the wellbore 102 for placing the fluid in contact with the plurality of grains 202 of the porous gravel pack 122. Examples of the injected fluid can include oil, water, carbon dioxide, gas such as steam, or hydrogen. In response to contact with the fluid, the core 204 of each grain 202 can expand to the expanded position. Portions of the cores 204 from different grains 202 that are exposed to the downhole fluid and not covered by the sheath 206 can bond together. Because the sheath 206 can act as a barrier, the sheath 206 may prevent other portions of cores 204 from different grains 202 from bonding together. Preventing portions of the grains 202 from bonding can maintain a fluid passageway for production flow to flow through the porous gravel pack 122 after expansion of the grains 202.

In some aspects, method and system for a self-assembling porous gravel pack in a wellbore are provided according to one or more of the following examples:

Example 1 is a system for use downhole in a wellbore comprising: a tubing string positionable downhole in a wellbore; and a porous gravel pack positionable in an annulus defined at least in part by a surface of the tubing string, the porous gravel pack comprising a plurality of grains, each grain of the plurality of grains comprising: a core comprising an expandable material, the expandable material configured to expand in response to coming in contact with a fluid; and a sheath surrounding the core, wherein the sheath is deformable in response to an expansion of the core.

Example 2 is the system of example(s) 1, wherein the sheath is configured to prevent at least a first portion of a first expandable material from a first grain of the plurality of grains from bonding with a second portion of a second expandable material from a second grain of the plurality of grains for maintaining a fluid passageway for production flow through the porous gravel pack after each of the cores of the plurality of grains expand in response to coming into contact with the fluid.

Example 3 is the system of example(s) 1-2, wherein at least a portion of the expandable material is configured to bond with at least another portion of another core of another grain of the plurality of grains.

Example 4 is the system of example(s) 1-3, wherein the core comprises at least one of magnesium, calcium, zinc, or aluminum.

Example 5 is the system of example(s) 1-4, wherein the sheath comprises a metal material or a polymer material.

Example 6 is the system of example(s) 1-5, wherein the sheath comprises at least one of a steel alloy, a bronze alloy, Ni, Al, Cu, Sn, Zn, or Ti.

Example 7 is the system of example(s) 1-6, wherein the sheath comprises at least one of elastomeric material, a thermoplastic material, or a thermoset material.

Example 8 is the system of example(s) 1-7, wherein the sheath comprises at least one of hydrogenated nitrile rubber, nylon, polyamide, polyvinylchloride, polystyrene, acrylonitrile butadiene styrene, polycarbonate, polysulfone, silicone, or vinyl.

Example 9 is the system of example(s) 1-8, further comprising: a sand screen positionable between the porous gravel pack and the wellbore, wherein the sand screen is configured to retain the grains of the porous gravel pack between the sand screen the surface of the tubing string.

Example 10 is the system of example(s) 1-9, wherein the porous gravel pack has a porosity of from about 30% to about 90%.

Example 11 is a method of installing a porous gravel pack downhole in a wellbore, the method comprising: positioning a porous gravel pack around a tubing string, the porous gravel pack comprising a plurality of grains, each grain of the plurality of grains comprising: a core comprising an expandable material that expands in response to coming in contact with a fluid from an unexpanded position to an expanded position; and a sheath surrounding the core, wherein the sheath is deformable in response to the core expanding to the expanded position; and injecting a fluid into the wellbore for placing the fluid in contact with the plurality of grains of the porous gravel pack, wherein in response to contact with the fluid, the core of each grain of the plurality of grains expands to the expanded position.

Example 12 is the method of example(s) 11, further comprising: preventing, by the sheath, a first portion of a first core from a first grain of the plurality of grains from bonding with a second portion of a second core from a second grain of the plurality of grains for maintaining a fluid passageway for production flow through the porous gravel pack after each of the cores of the plurality of grains expand in response to coming into contact with the fluid.

Example 13 is the method of example(s) 11-12, wherein the step of positioning the porous gravel pack around the tubing string further comprises securing the plurality of grains of the porous gravel pack to the tubing string prior to positioning the tubing string downhole in the wellbore.

Example 14 is the method of example(s) 11-13, wherein the step of securing the plurality of grains of the porous gravel pack to the tubing string prior to positioning the tubing string downhole in the wellbore further comprising securing the plurality of grains to a surface of the tubing string using an adhesive.

Example 15 is the method of example(s) 11-14, wherein the step of positioning the porous gravel pack around the tubing string further comprises pumping the plurality of grains of the porous gravel pack downhole between a surface of the tubing string and a subterranean formation.

Example 16 is the method of example(s) 11-15, wherein the core includes at least one of magnesium, calcium, zinc, or aluminum, and wherein the sheath includes a metal material or a polymer material.

Example 17 is the method of example(s) 11-16, wherein the sheath includes at least one of an elastomeric material, a thermoplastic material, or a thermoset material.

Example 18 is the method of example(s) 11-17, wherein the sheath includes at least one of hydrogenated nitrile rubber, nylon, polyamide, polyvinylchloride, polystyrene, acrylonitrile butadiene styrene, polycarbonate, polysulfone, silicone, or vinyl.

Example 19 is the method of example(s) 11-18, further comprising: positioning a sand screen between the porous gravel pack and the wellbore to secure the porous gravel pack between a surface of the tubing string and an inner surface of the sand screen.

Example 20 is the method of example(s) 11-19, wherein the porous gravel pack has a porosity of from 30% to 90%.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system for use downhole in a wellbore comprising:

a tubing string positionable downhole in a wellbore; and a porous gravel pack positionable in an annulus defined at least in part by a surface of the tubing string, the porous gravel pack comprising a plurality of grains, each grain of the plurality of grains having an unexpanded position and an expanded position, wherein each grain of the plurality of grains comprises:

a core comprising an expandable material, the expandable material configured to expand from the unexpanded position to the expanded position in response to coming in contact with a fluid; and a sheath surrounding a portion of the core, wherein the sheath does not fully extend over at least one end of the core in the unexpanded position, wherein the sheath is deformable in response to the expansion of the core into the expanded position, wherein in the expanded position, each grain of the plurality of grains has a length to diameter ratio that is greater than 1, and wherein in the expanded position a fluid passageway is formed between a first grain of the plurality of grains and a second grain of the plurality of grains, the fluid passageway being defined by a deformed first sheath of the first grain and a deformed second sheath of the second grain, wherein the deformed first sheath and the deformed second sheath prevent a portion of the core of the first grain of the plurality of grains from contacting a portion of the core of the second grain of the plurality of grains for defining the fluid passageway.

2. The system of claim 1, wherein at least a portion of the expandable material is configured to bond with at least another portion of another core of another grain of the plurality of grains.

3. The system of claim 1, wherein the core comprises at least one of magnesium, calcium, zinc, or aluminum.

4. The system of claim 1, wherein the sheath comprises a metal material or a polymer material.

5. The system of claim 4, wherein the sheath comprises at least one of a steel alloy, a bronze alloy, Nickel (Ni), Aluminum (Al), Copper (Cu), Tin (Sn), Zinc (Zn), or Titanium (Ti).

6. The system of claim 4, wherein the sheath comprises at least one of elastomeric material, a thermoplastic material, or a thermoset material.

7. The system of claim 6, wherein the sheath comprises at least one of hydrogenated nitrile rubber, nylon, polyamide, polyvinylchloride, polystyrene, acrylonitrile butadiene styrene, polycarbonate, polysulfone, silicone, or vinyl.

8. The system of claim 1, further comprising:

a sand screen positionable between the porous gravel pack and the wellbore, wherein the sand screen is configured to retain the grains of the porous gravel pack between the sand screen and the surface of the tubing string.

9. The system of claim 1, wherein the porous gravel pack has a porosity of from about 30% to about 90%.

10. A method of installing a porous gravel pack downhole in a wellbore, the method comprising:

positioning a porous gravel pack around a tubing string, the porous gravel pack comprising a plurality of grains, each grain of the plurality of grains having an unexpanded position and an expanded position, wherein each grain of the plurality of grains comprises:

a core comprising an expandable material that expands in response to coming in contact with a fluid from an unexpanded position to an expanded position; and a sheath surrounding a portion of the core, wherein the sheath does not fully extend over at least one end of the core in the unexpanded position, wherein the sheath is deformable in response to the core expanding to the expanded position wherein in the expanded position, each grain of the plurality of grains has a length to diameter ratio that is greater than 1, and wherein in the expanded position a fluid passageway is formed between a first grain of the plurality of grains and a second grain of the plurality of grains, the fluid passageway being defined by a deformed first sheath of the first grain and a deformed second sheath of the second grain, wherein the deformed first sheath and the deformed second sheath prevent a portion of the core of the first grain of the plurality of grains from contacting a portion of the core of the second grain of the plurality of grains for defining the fluid passageway; and injecting the fluid into the wellbore for placing the fluid in contact with the plurality of grains of the porous gravel pack, wherein in response to contact with the fluid, the core of each grain of the plurality of grains expands to the expanded position.

11. The method of claim 10, wherein the step of positioning the porous gravel pack around the tubing string further comprises securing the plurality of grains of the porous gravel pack to the tubing string prior to positioning the tubing string downhole in the wellbore.

12. The method of claim 11, wherein the step of securing the plurality of grains of the porous gravel pack to the tubing string prior to positioning the tubing string downhole in the wellbore further comprising securing the plurality of grains to a surface of the tubing string using an adhesive.

13. The method of claim 10, wherein the step of positioning the porous gravel pack around the tubing string further comprises pumping the plurality of grains of the porous gravel pack downhole between a surface of the tubing string and a subterranean formation.

14. The method of claim 10, wherein the core includes at least one of magnesium, calcium, zinc, or aluminum, and wherein the sheath includes a metal material or a polymer material.

15. The method of claim 13, wherein the sheath includes at least one of an elastomeric material, a thermoplastic material, or a thermoset material.

16. The method of claim 15, wherein the sheath includes at least one of hydrogenated nitrile rubber, nylon, polyamide, polyvinylchloride, polystyrene, acrylonitrile butadiene styrene, polycarbonate, polysulfone, silicone, or vinyl.

17. The method of claim 10, further comprising:

positioning a sand screen between the porous gravel pack and the wellbore to secure the porous gravel pack between a surface of the tubing string and an inner surface of the sand screen.

18. The method of claim 10, wherein the porous gravel pack has a porosity of from 30% to 90%.

* * * * *